US006945826B2

(12) United States Patent
Wise

(10) Patent No.: US 6,945,826 B2
(45) Date of Patent: Sep. 20, 2005

(54) METHOD AND APPARATUS FOR PREVENTING ELECTRIC SHOCKING

(76) Inventor: Charles Michael Wise, 831 S. Peatl St., Columbus, OH (US) 43206

( * ) Notice: Subject to any disclaimer, the term of this patent is extended or adjusted under 35 U.S.C. 154(b) by 0 days.

(21) Appl. No.: 10/836,746

(22) Filed: Apr. 30, 2004

(65) Prior Publication Data

US 2004/0219840 A1 Nov. 4, 2004

Related U.S. Application Data

(60) Provisional application No. 60/467,487, filed on May 2, 2003.

(51) Int. Cl.[7] ..... H01R 13/04
(52) U.S. Cl. ..... 439/693; 439/682; 439/106
(58) Field of Search ..... 439/692–693, 439/682–683, 106

(56) References Cited

U.S. PATENT DOCUMENTS

| | | | | |
|---|---|---|---|---|
| 2,226,148 A | | 12/1940 | Taylor | 173/330 |
| 3,533,052 A | | 10/1970 | Degaetano | 339/195 |
| 3,631,320 A | | 12/1971 | Eckert | 317/9 R |
| 3,710,287 A | | 1/1973 | Eckert | 339/195 R |
| 5,248,268 A | * | 9/1993 | Rinker | 439/682 |
| 5,641,311 A | | 6/1997 | Chuang | 439/693 |
| 5,897,398 A | | 4/1999 | Maeda | 439/693 |
| 6,109,977 A | | 8/2000 | Baxter et al. | 439/693 |

* cited by examiner

*Primary Examiner*—Truc Nguyen
(74) *Attorney, Agent, or Firm*—David A. Greenlee

(57) ABSTRACT

A safety electrical plug has two-part prongs. Each prong has a distal portion that is electrically insulated and a proximal portion that is conductive. Substantially full insertion of the plug into a receptacle is required to establish an electrical connection between the prongs and the receptacle contacts. This limits the chance of electric shocking by human or animal engagement of the exposed portions of the prongs subsequent to only partial insertion of the plug into the receptacle, and signals the partially-inserted condition when subsequent attempts to operate an electrical appliance connected to the plug fails. The conductive prong portions may be inserts in a nonconductive base, or be the entire proximal portions, which may optionally mount a strip of nonconductive material along their edges.

9 Claims, 2 Drawing Sheets

Fig. 1
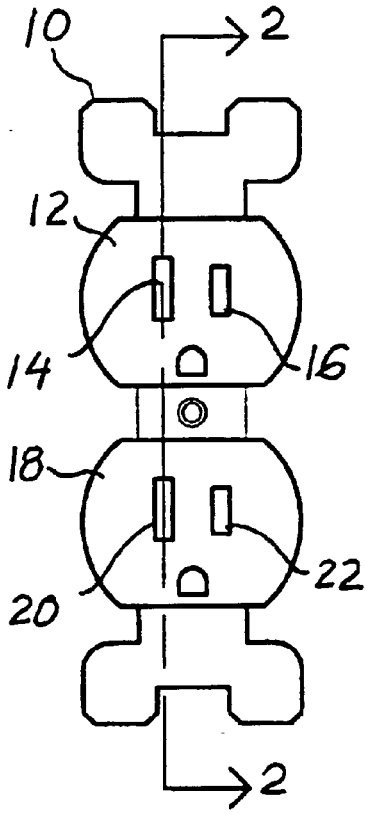
Fig. 2
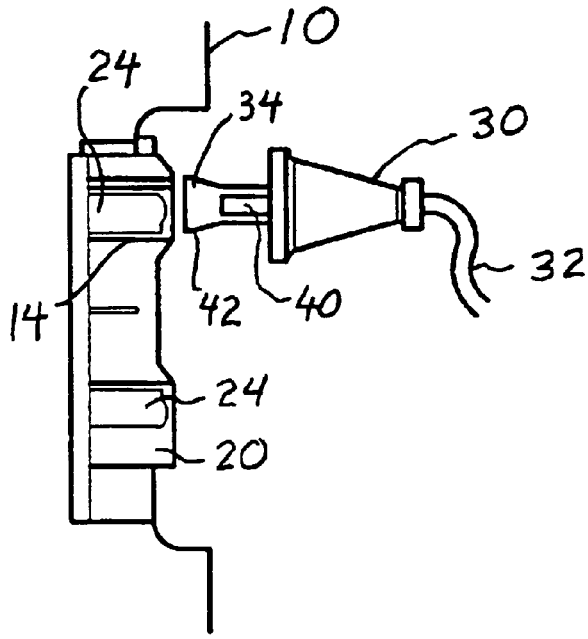
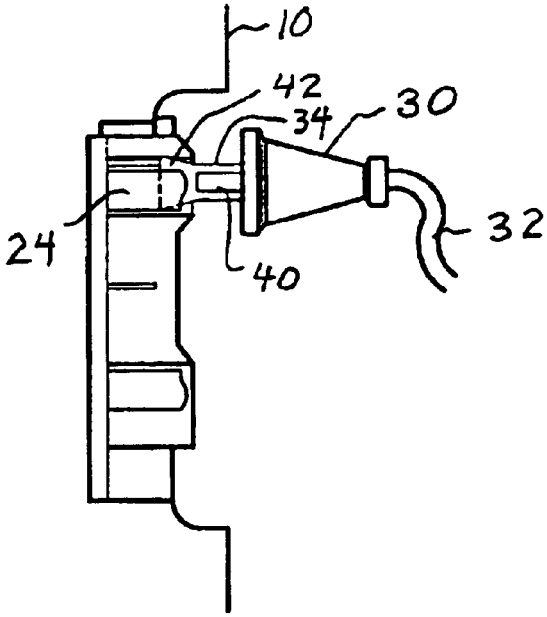
Fig. 3
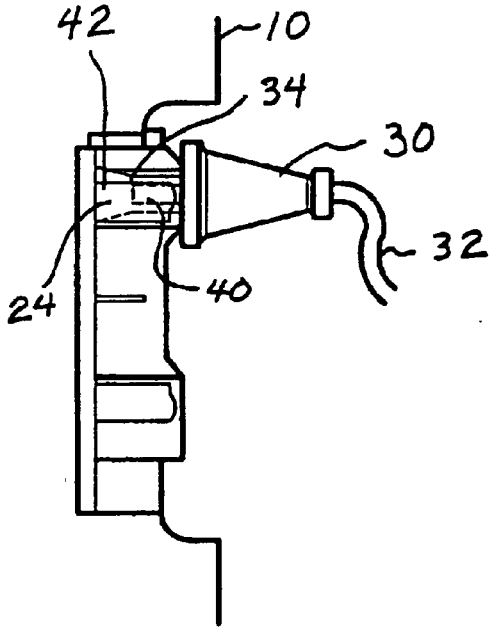
Fig. 4

METHOD AND APPARATUS FOR PREVENTING ELECTRIC SHOCKING

RELATED APPLICATIONS

This application claims priority of U.S. Provisional patent application Ser. No. 60/467,487, filed May 2, 2003.

BACKGROUND OF THE INVENTION

1. Field of the Invention

This invention relates generally to electric plugs and, more particularly, to an electric plug which prevents accidental electric shock when the plug is only partially inserted into an electric socket.

2. Prior Art

Electrical devices, such as lamps, sweepers, kitchen appliances, power tools, television sets, stereos, and many others all have electrical cords extending from them. These cords all carry a terminal plug that is inserted into an electrical outlet to power the devices. Each plug has two or more prongs that are inserted into mating slots in the socket of an insulated receptacle, where they engage electrically-conductive contacts. These contacts not only establish electrical contact with the prongs, but also grip the prongs with sufficient force to prevent accidental withdrawal of the plug.

A problem develops when a plug is only partially inserted into the socket, thereby leaving a gap between plug and receptacle with a portion of both prongs exposed. If the gap is sufficient, two things can occur. First, if there is no electrical contact, the appliance will not operate. Second, if there is electrical contact, someone, usually a child, or something, such as a household, pet, could insert a body part into the gap and touch the exposed portions of both prongs simultaneously. If so, an electric shock will ensue, much to the hazard of the child. This could cause burns or worse, depending on the size of the child. Also, even if only a very slight gap exists between plug and receptacle, too shallow for fingers to intrude, a thin metal object, such as a letter opener, screwdriver, table knife, fork or spoon could be inserted by an inquisitive child resulting in the same potentially-disastrous shocking incident.

Another problem with exposed, electrically-conductive prongs is a danger of house fire. Research has indicated that over 20% of house fires in the U.S. are caused by arcing or shorting or other malfunctioning of electrical plugs.

In recognition of these hazards, and in response to many incidents of such accidental shockings of small children, many attempts have been made to devise a safety plug which reduces the chance of such accidental shockings. Many of these comprise electric plugs having an insulating material installed on the prongs adjacent the plug base. In the case of partial plug insertion, this arrangement leaves only the insulated portion of the prongs exposed, preventing accidental shocking.

In one version, the plug prongs are cut away adjacent the plug base and an insulating material insert is installed, as shown in U.S. Pat. No. 3710287—Eckert, U.S. Pat. No. 3,533,052—Degataeno, U.S. Pat. No. 5,641,311—Chuang, and U.S. Pat. No. 6,109,977—Baxter et al. The problem with this solution to the accidental shocking problem is that the prongs are weakened near their base, resulting in inability to endure repeated flexures, as their plugs are repeatedly inserted into and yanked out of receptacles, often accompanied by bending of the prongs, without fatiguing and breaking. Another problem with this type of construction is the eventual wearing of the insulating material, which will eventually expose the conductive prong base, thus defeating the protection. Also, the protective coating could be accidentally cut, with the same result Another type of so-called safety pug features the addition of an insulating sleeve on the prongs adjacent their bases, as shown in U.S. Pat. No. 2,226,148—Taylor and U.S. Pat. No. 5,897,398—Maeda. One problem with this construction is that this thickens the prongs so much that insertion and withdrawal are rendered much more difficult, due to the increased friction caused by the added thickness of the prongs which the receptacle contacts must accept. Also, the sleeves could be cut, as above, or pulled off the prongs.

A third proposed solution is shown in U.S. Pat. No. 3,631,320—Eckert in which a flexible, resilient sleeve, boot or bellows is attached to the plug body surrounding the prongs. As the prongs are inserted into a receptacle, the boot engages the receptacle and is compressed between the receptacle and the prongs. This arrangement overcomes the thickness problem of static sleeves, but is an expensive addition to the plug, and it, too, could suffer failure if the boots are cut or wear out, or are pulled off.

Thus, there is a need for a safety plug which will prevent accidental shockings, and which is not prone to failures due to wear, cutting or dislodgement.

There is also a need for a safety plug which will not suffer prong fatigue and breaking.

It would also be advantageous to provide an electrical plug attached to an electrical appliance that indicates failure to fully insert the plug into an electric receptacle by rendering the appliance inoperable.

SUMMARY OF THE INVENTION

Accordingly, an object of this invention is to provide a safety plug which will prevent accidental electrical shockings, and which is not prone to failures due to wear, cutting or dislodgement.

It is another object to provide a safety plug which will not suffer prong fatigue and breaking.

It is a further object of this invention to provide an electrical plug attached to an electrical appliance that indicates failure to fully insert the plug into an electric receptacle by rendering the appliance inoperable.

Accordingly, in one aspect, this invention features a safety electrical plug having two or more electrically-conductive prongs extending from a plug body for insertion into an electric receptacle that has electrically-conductive contacts, each prong having a base portion extending from the plug and including an exposed electrically-conductive segment, and a non-conductive end portion extending from the base portion, whereby the base portion is sized to establish electrical connection with the contact only upon substantially full insertion of the plug into the receptacle.

In another aspect, this invention features safety electric plug for connecting an electric device to a source of electric current in a receptacle socket, which has electrical contacts for gripping and for establishing an electrical connection with each plug prong having a plug body, and a pair of spaced prongs extending from the plug body for insertion into the receptacle. The prongs each have a proximal portion extending from the plug body and a distal portion extending from the proximal portion. The proximal portion has an electrically-conductive segment for establishing an electrical connection upon full insertion of the prong into the receptacle, and the distal portion has a non-conductive, insulating exterior for preventing said electrical connection upon initial insertion of the prong into the receptacle. The distal portion is gripped by the contacts upon full insertion to retain the plug in the socket, which prevents electrical connection until the plug is substantially fully inserted into the socket.

In one embodiment, the proximal portion of each prong is entirely made of conductive material, and the distal portion is entirely made of non-conductive material bonded to the proximal portion. Preferably, the proximal portion is approximately half the length of each prong.

In another embodiment, the prongs are made of a non-conductive material each having a current-conducting electrical wire, and the electrical conductive segment is an insert of conducting material embedded in the exterior of the proximal portion of each prong and in contact with the wire, with a strip of non-conductive material extending along each conductive portion edge.

In a further aspect, this invention features a method of preventing electrical shocking by exposure of portions of the prongs of an electric plug upon partial insertion into an electric receptacle, comprising the steps of providing each prong with a base portion extending from the plug that has an exposed electrically-conductive segment, providing each prong with a non-conductive end portion extending from the base portion, and sizing both portions such that substantial full insertion of the prongs into the receptacle is necessary to establish electrical connection between the plug and the receptacle.

These and other objects and features will become more readily apparent upon reference to the following detailed description, which refers to the accompanying drawings, in which:

DESCRIPTION OF THE DRAWINGS

FIG. 1 is a front view of a conventional double socket electric wall-type receptacle, illustrated alone for clarity;

FIG. 2 is a sectional view taken along line 2—2 of FIG. 1, additionally showing an American 110 v electric plug poised for insertion in one of the sockets;

FIG. 3 is a view similar to FIG. 2, but showing the plug prongs partially inserted;

FIG. 4 is a view similar to FIG. 3, but showing the plug prongs fully inserted;

DETAILED DESCRIPTION OF THE INVENTION

Figure 5:
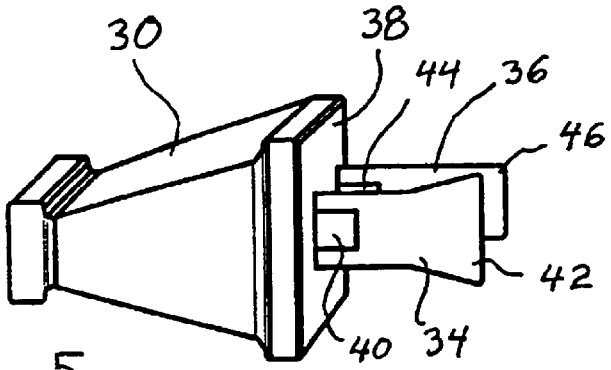
FIG. 5 is a perspective view of the plug of FIGS. 2–4 which incorporate the invention.
Figure 6:
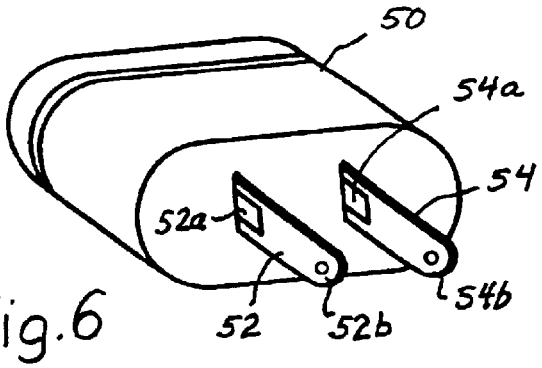
FIGS. 6, 7, 8 and 9 are perspective views of non-American-style plugs which incorporate the invention.

Referring now to FIGS. 1–5, a conventional wall-type 110 v double electrical receptacle 10 is normally mounted in a recess in a wall and covered with a wall plate, not illustrated, in a conventional manner to provide 110 v electric service for lamps and small appliances in homes, offices and other buildings. Receptacle 10 includes an upper socket 12 having slots 14 and 16 for receiving plug prongs and a lower socket 18 having slots 20 and 22 for receiving prongs of an electrical plug. Each socket slot has a pair of internal spaced, parallel electricity-conducting contacts or blades, only one of which 24 is shown in FIGS. 2–4. The blades 24 serve two functions, to grip and frictionally retain electrical plug prongs, and to make electrical contact with the prongs.

FIG. 5 shows an electrical plug 30 according to this invention. Plug 30 is at the terminal end of an electrical cord 32 that is attached to an electrical device or appliance (not shown), such as a radio, TV, stereo, lamp, iron, mixer, vacuum cleaner, fan, power tools, etc. Plug 30 has a non-conductive body made from a dielectric material, such as plastic, and has a front face 38 from which extend large and small prongs 34 and 36. In normal electrical plugs, the prongs are made of conducting metal so that, upon insertion into a socket, they make electrical contact with the blades 24 to conduct electric current to operate the device or appliance connected to the plug.

In a conventional plug, electrical contact is made upon only partial plug insertion. If the plug prongs are not fully inserted into the receptacle, and are partially exposed, contact with the prongs by someone, such as a child, can cause electric shock. This partial insertion can be caused by plug insertion with insufficient force, or, also, by partial plug withdrawal, such as when the cord is stressed sufficiently to partially withdraw the plug from the socket. This action may well go unnoticed because the connected appliance will still operate, since electric current is still flowing to it. As such, a partially inserted conventional plug is an accidental shock safety hazard.

The plug 30 of this invention substantially removes this accidental shock safety hazard. As best seen in FIG. 5, prong 34 extends from plug face 38 and is formed of a base or proximal portion or segment 40 that is electrically conductive and an end or distal portion 42 that is made from a non-conductive or dielectric material, such as plastic. In the embodiment of FIG. 5, the non-conductive material actually extends along both top and bottom edges of conductive segment 40 to the plug face 30. In similar fashion, plug prong 36 includes a conductive proximal segment 44 and a non-conductive portion 46. These electrically conductive proximal prong portions 40, 44 are connected to the usual electrical wires in cord 32 that convey electric current to the connected appliance.

With this arrangement, when plug 30 is only partially inserted, as in FIG. 3, only the distal non-conducting prong portions 34 and 46 contact socket blades 24, and there is no chance of an accidental electric shock, although the plug will remain only partially inserted. This condition of only partial plug insertion (and no electrical conductance) will become readily apparent when there is an attempt to use the connected electric appliance, which will not function. This will prompt a user to fully insert plug 30, as in FIG. 4, which will cause the electrically conducting proximal segments 40 and 44 of prongs 34 and 36 to engage blades 24, resulting in electrical conductance, which enables the appliance to function.

In this manner, the condition of only partial plug insertion into a socket will not cause any electrical shock safety hazard, since there is no electrical conductivity, and this condition will reveal itself when there is an attempt to use the connected appliance. In contrast, the other types of so-called safety plugs referenced above permit electrical conductivity in a plug even when it is only partially inserted, because they place a nonconductive coating or boot about the proximal end of the prongs.

Although FIGS. 1–5 illustrate use of the invention in an American-style 110 v plug, it is useful in other types of plugs conventionally used for 220 v current in this country. It can also be used in electrical plugs used in other parts of the world, as illustrated in FIGS. 6, 7, 8 and 9. Plug 50 has prongs 52, 54 each having conductive proximal segments

52*a*, 54*a*, and non-conductive distal portions 52*b*, 54*b*. Similarly, plug 60 has prongs 62, 64 with conductive proximal segments 62*a*, 64*a* and dielectric distal portions 62*b*, 64*b*, while plug 70 has prongs 72, 74 with conductive proximal segments 72*a*, 74*a*, and dielectric distal portions 72*b*, 74*b*. Plug 80 has three prongs 82, 84, 86 having conductive proximal segments 82*a*, 84*a*, 86*a*, and non-conductive distal portions 82*b*, 84*b* and 86*b*.

The actual prong structure may take many forms. The exact shape of the conductive and non-conductive portions of the prongs can be varied from those shown. It may comprise a solid metal proximal portion with an extended core, about which the non-conductive material distal portion is molded. Or the entire prong may be non-conductive material, with metal inserts (as illustrated herein) connected internally to the cord wires. Alternatively, the inserts could be only on the facing, or only on the non-facing surfaces of the prongs. The conductive proximal portions could extend half the length of the prong or less or more than half the length, depending on the environment of use.

Figure 7:
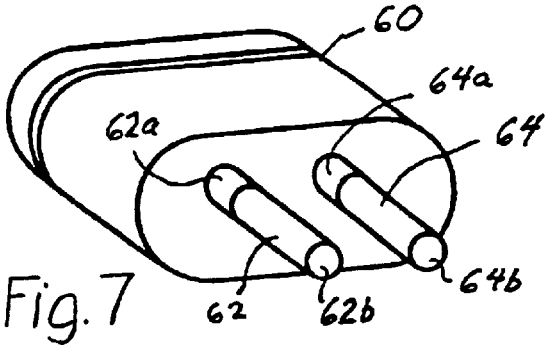
Figure 8:
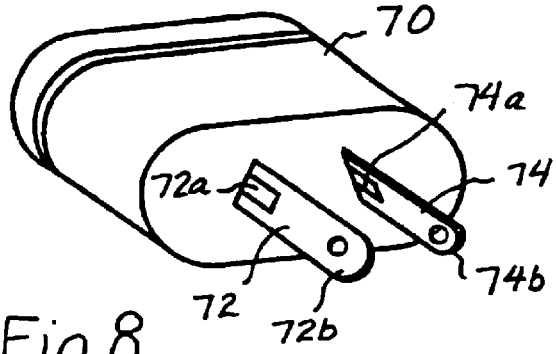
Figure 9:
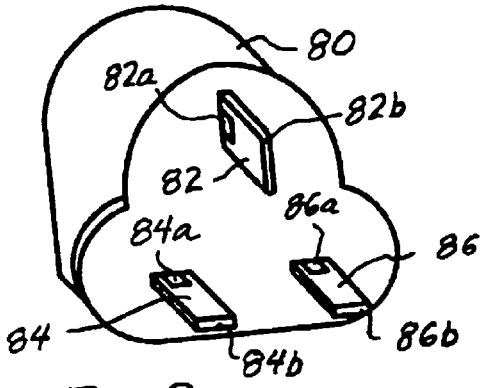

Note that in FIGS. 1–8, the conductive proximal portions are illustrated as inserts in the non-conductive material prong, while the FIG. 7 embodiment has proximal complete circular bands 62*a*, 64*a*. It is important that the distal portions of the prongs have a non-conductive exterior to prevent electrical contact with the electrical socket upon only partial plug insertion, and that the proximal prong portions have a conductive exterior surface for contacting the conductive blades in the socket to effect electrical conductivity upon full insertion. In all embodiments, the structure of the prongs is simple, inexpensive and extremely sturdy.

While only preferred embodiments of this invention have been disclosed and described, modifications thereof will become readily apparent, and are contemplated within the scope of this invention, as defined in the appended claims. Although plug 30 is illustrated as used in a household wall receptacle, it can be used with an extension cord or any of the many other types of electrical outlets or sockets in use.

I claim:

1. A safety electrical plug for connecting an electrical device to a source of electric current in a conventional electric receptacle which has electric contacts for gripping the exterior of, and establishing an electrical connection with, each plug prong, comprising a plug body, a pair of spaced prongs extending from the plug body for insertion into the socket, the prongs each having a proximal portion extending from the plug body and a distal portion extending from the proximal portion, the proximal portion having an electrically-conductive exterior segment for establishing an electrical connection with an electric contact upon full insertion of the prong into the receptacle, the distal portion having a non-conductive exterior for preventing said electrical connection upon partial insertion of the prong into the receptacle, thereby preventing said electrical connection until the plug is substantially fully inserted into the socket.

2. The safety electric plug of claim 1, wherein the prongs are made of a non-conductive material, and the electrically-conductive segment is an insert of conducting material embedded in the exterior of the proximal portion of each prong and in contact with the wire.

3. The safety electric plug of claim 2, wherein the prongs are arranged in parallel and each said electrically-conductive segment is imbedded in the portion of the prong facing the other prong.

4. The safety electric plug of claim 2, wherein each said electrically-conductive segment is a band extending about the periphery of the prong.

5. The safety electric plug of claim 1, wherein the proximal portion of each prong is entirely made of conductive material, and the distal portion is entirety made of non-conductive material bonded to the proximal portion.

6. The safety electric plug of claim 1, wherein each electrically-conductive segment is approximately half the length of the prong.

7. A safety electric plug having two or more eledrically-condudive prongs extending from a plug body for insertion into a conventional electric receptacle that has electrically-conductive contacts, each prong having a base portion extending from the plug and including an exposed electrically-conductive exterior segment, and a non-conductive end portion extending from the base portion, whereby the base portion is sized to establish electrical connection with the contact only upon substantially full insertion of the plug into the receptacle.

8. The safety electric plug of claim 7, wherein the prong base portions are flat members each having narrow top and bottom edges connected by broad flat sides, and including a strip of non-conductive material mounted on each edge.

9. A method of preventing electrical shocking by contact with portions of the prongs of an electric plug upon partial insertion of the plug into a conventional electric receptacle, comprising the steps of providing each prong with a base portion extending from the plug that has an exposed electrically-conductive exterior segment, and providing each prong with a non-conductive end portion extending from the base portion, and sizing both prong portions such that substantial full insertion of the prongs into the receptacle is necessary to establish electrical connection between the plug and the receptacle.

* * * * *